US009557701B2

(12) United States Patent
Maruyama

(10) Patent No.: US 9,557,701 B2
(45) Date of Patent: Jan. 31, 2017

(54) SHEET CONVEYANCE APPARATUS

(71) Applicants: KABUSHIKI KAISHA TOSHIBA, Tokyo (JP); TOSHIBA TEC KABUSHIKI KAISHA, Tokyo (JP)

(72) Inventor: Shinji Maruyama, Izunokuni Shizuoka (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/627,673

(22) Filed: Feb. 20, 2015

(65) Prior Publication Data

US 2016/0246237 A1 Aug. 25, 2016

(51) Int. Cl.

| | |
|---|---|
| ***B65H 9/04*** | (2006.01) |
| ***G03G 15/00*** | (2006.01) |
| ***B65H 9/00*** | (2006.01) |
| ***B65H 7/20*** | (2006.01) |
| ***B65H 7/08*** | (2006.01) |
| ***B65H 5/06*** | (2006.01) |

(52) U.S. Cl.

CPC ..... *G03G 15/6558* (2013.01); *B65H 5/068* (2013.01); *B65H 7/08* (2013.01); *B65H 7/20* (2013.01); *B65H 9/002* (2013.01)

(58) Field of Classification Search

CPC ..... B65H 9/004; B65H 9/006; B65H 9/008; B65H 9/14; B65H 9/002

USPC ..... 271/226, 227, 242, 243

See application file for complete search history.

(56) References Cited

U.S. PATENT DOCUMENTS 8,328,188 B2 * 12/2012 Mandel ..... B65H 9/002 271/228
2006/0267271 A1 * 11/2006 Mandel ..... B65H 9/002 271/226

FOREIGN PATENT DOCUMENTS

JP 6-1498 * 1/1994
JP 3191834 * 5/2001

OTHER PUBLICATIONS

Machine translation of JP6-1498.*

* cited by examiner

*Primary Examiner* — Thomas Morrison
(74) *Attorney, Agent, or Firm* — Patterson & Sheridan, LLP

(57) ABSTRACT

An image forming apparatus comprises a conveyance roller, a register roller, a sensor, a movable section, and a control section. The conveyance roller conveys a sheet. The register roller is arranged downstream of the conveyance roller along a sheet conveyance path. The sensor detects a deflection amount of the sheet when the sheet is pressed against the register roller. The movable section is connected to at least one end part of the conveyance roller. The control section controls the movable section to move the at least one end of the conveyance roller based on the deflection amount detected by the sensor, to tilt a rotational axis of the conveyance roller relative to a rotational axis of the register roller.

18 Claims, 7 Drawing Sheets

SHEET CONVEYANCE APPARATUS

FIELD

Embodiments described herein relate generally to a sheet conveyance apparatus.

BACKGROUND

An image forming apparatus conveys a sheet-like medium (hereinafter collectively referred to as "sheet") such as paper and forms an image on the sheet. The image forming apparatus includes a plurality of rollers arranged along a conveyance path. The plurality of rollers in may convey the sheet in a deflected state.

For example, the image forming apparatus includes a conveyance roller and a register roller. The conveyance roller conveys the sheet conveyed from a sheet housing section towards the register roller. When the front end of the sheet reaches the register roller, the register roller is stopped. The conveyance roller continues conveying the sheet after the sheet reaches the register roller. In this way, the front end of the sheet is pressed against the register roller. Then, the rotation of the conveyance roller is stopped.

The sheet may become inclined in the conveyance direction during the process of being picked up from the sheet housing section or the process of being conveyed along the conveyance path. In such a case, the sheet nipped by the conveyance roller is inclined, meaning that the front end of the sheet conveyed towards the register roller is not parallel to the rotation axis of the register roller.

However, the front end of the sheet becomes parallel to the rotation axis of the register roller when the front end of the sheet is pressed against the register roller. However, the sheet nipped by the conveyance roller is still in the inclined state. As a result, the deflection amount of the sheet is not uniform at the left and right side of the sheet in the conveyance direction. In this non-uniformly deflected state, the sheet is drawn in by the register roller. Then the non-uniformly deflected sheet is compressed by the register roller, which may cause flaws such as a wrinkle in the sheet.

DETAILED DESCRIPTION

Figure 1:
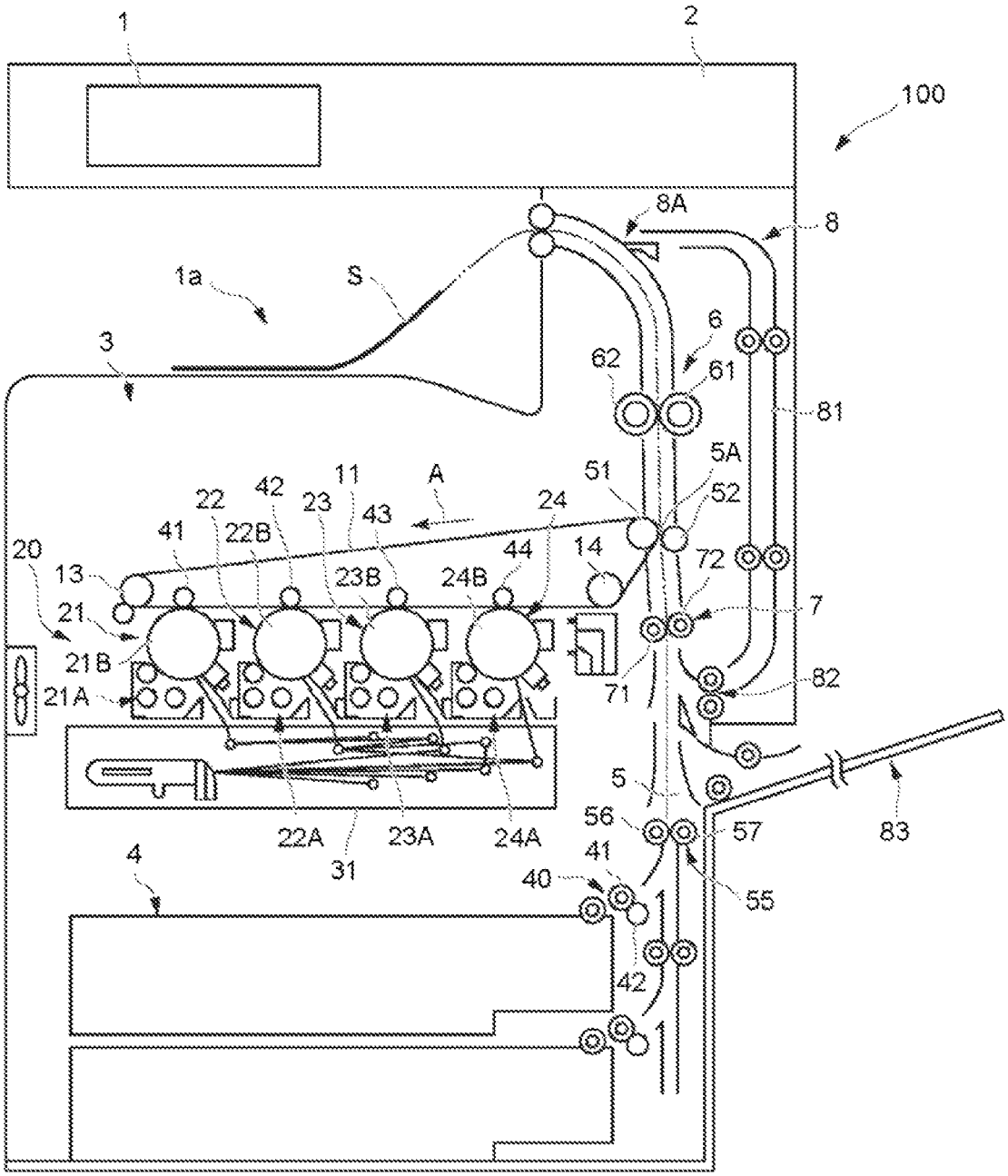
FIG. 1 is a schematic diagram illustrating an example of an image forming apparatus according to one embodiment.

In accordance with one embodiment, an image forming apparatus comprises a conveyance roller, a register roller, a sensor, a movable section, and a control section. The conveyance roller conveys a sheet. The register roller is arranged downstream of the conveyance roller along a sheet conveyance path. The sensor detects a deflection amount of the sheet when the sheet is pressed against the register roller. The movable section is connected to at least one end part of the conveyance roller. The control section controls the movable section to move the at least one end of the conveyance roller based on the deflection amount detected by the sensor, to tilt a rotational axis of the conveyance roller relative to a rotational axis of the register roller.

Hereinafter, an image forming apparatus 100 according to the embodiment is described with reference to the accompanying drawings. The same components in each figure are applied with the same reference numerals.

FIG. 1 is a schematic diagram illustrating an image forming apparatus 100 according to the embodiment.

As shown in FIG. 1, the image forming apparatus 100 includes a scanner section 2, a printer section 3 and a sheet housing section 4.

The scanner section 2 reads image information of a copy object as brightness and darkness of light and outputs the read image information to the printer section 3.

The printer section 3 transfers an output image (hereinafter referred to as toner image) visualized with developing agent such as toner to a sheet S serving as an image transferred medium, based on the image information output from the scanner section 2. The printer section 3 applies heat and pressure to the sheet S to which the toner image is transferred to fix the toner image on the sheet S.

The sheet housing section 4 respectively stores a plurality of sheets S of different given sizes for each size of the sheet S. A sheet feed roller pair 40 is arranged near the exit of the sheet housing section 4. The sheet feed roller pair 40 includes a sheet feed driving roller 41 and a sheet feed driven roller 42. The sheet feed driving roller 41 rotates in a given direction. The sheet feed driven roller 42 is pressed against the sheet feed driving roller 41 at a given pressure by a pressure mechanism (not shown).

The sheet feed roller pair 40 picks up the sheet S one by one when the toner image is to be formed thereon in the printer section 3 and supplies the picked up sheet S to the printer section 3.

A conveyance path 5 is arranged between the sheet housing section 4 and the printer section 3. Conveyance path 5 conveys the sheet S from the sheet housing section 4 to the printer section 3. The conveyance path 5 includes a transfer position 5A. The transfer position 5A is a position where the toner image formed in the printer section 3 is transferred to the sheet S. The sheet S is conveyed through the transfer position 5A towards a fixing device 6.

In the present embodiment, the upstream side with respect to the flow of the sheet S conveyed on the conveyance path 5 is referred to as the upstream side of the conveyance path 5. The downstream side with respect to the flow of the sheet S conveyed on the conveyance path 5 is referred to as the downstream side of the conveyance path 5.

A conveyance roller pair 55 is arranged at the upstream side of the transfer position 5A on the conveyance path 5. The conveyance roller pair 55 includes a conveyance driving roller 56 and a conveyance driven roller 57. The conveyance driving roller 56 rotates in a given direction. The conveyance driven roller 57 is pressed against the conveyance driving roller 56 at a given pressure by a pressure mechanism (not shown).

The printer section 3 includes the fixing device 6, a register roller pair 7, a reversal unit 8, an intermediate transfer belt 11 and an image forming section 20.

The intermediate transfer belt 11 is arranged at a given position in the image forming apparatus 100. For example, the intermediate transfer belt 11 is arranged below the fixing device 6 in the vertical direction. For example, the intermediate transfer belt 11, which is an insulating film having a given thickness, is formed in a belt shape. The intermediate transfer belt 11 may also be a thin sheet-like metal having a surface protected with resin, or the like.

A given tension is applied to the intermediate transfer belt 11 by a transfer driving roller 51, a first tension roller 13 and a second tension roller 14. When the transfer driving roller 51 is rotated, any position on the intermediate transfer belt 11 parallel to the axis of the transfer driving roller 51 is moved in a direction indicated by an arrow A. In other words, the belt surface of the intermediate transfer belt 11 is circulated in one direction at a speed equal to the speed of the movement of the outer peripheral surface of the transfer driving roller 51.

The image forming section 20 is positioned where the belt surface of the intermediate transfer belt 11 is substantively moved in a plane, as the given tension is applied.

The image forming section 20 includes image forming units 21, 22, 23 and 24 which are arranged between the first tension roller 13 and the second tension roller 14 at given intervals.

Each of the image forming units 21, 22, 23 and 24 includes a developing device 21A, 22A, 23A and 24A and a photoconductor 21B, 22B, 23B and 24B, respectively. Each developing device 21A, 22A, 23A and 24A stores toner of one color. For example, C (cyan), M (magenta), Y (yellow) and BK (black) toner is stored in the developing devices 21A, 22A, 23A and 24A, respectively.

An exposure device 31 is arranged at a position opposite to the photoconductors 21B, 22B, 23B and 24B. The exposure device 31 forms an electrostatic image corresponding to a color to be developed on the photoconductors 21B, 22B, 23B and 24B. The toner is selectively supplied by the developing devices 21A, 22A, 23A and 24A to the photoconductors 21B, 22B, 23B and 24B. In this way, the electrostatic images on the surfaces of the photoconductors 21B, 22B, 23B and 24B are developed with toner. As a result, toner images are formed on the surface of the photoconductors 21B, 22B, 23B and 24B.

Opposing rollers 41, 42, 43 and 44 are arranged at positions opposite to the photoconductors 21B, 22B, 23B and 24B across the intermediate transfer belt 11. Each of the opposing rollers 41, 42, 43 and 44 presses the intermediate transfer belt 11 against the photoconductors 21B, 22B, 23B and 24B. In this way, the toner images formed on the photoconductors 21B, 22B, 23B and 24B are transferred to the intermediate transfer belt 11. The toner images on the surfaces of the photoconductors 21B, 22B, 23B and 24B are sequentially transferred to the intermediate transfer belt 11 at a given timing. The toner image of each color is formed on the intermediate transfer belt 11 through the transfer. The toner image of each color may overlap at a given position of the surface of the intermediate transfer belt 11, according to the image information.

At the transfer position 5A arranged on the conveyance path 5 is arranged a transfer driven roller 52 which is contacted with the intermediate transfer belt 11 at a given pressure. The transfer driven roller 52 is pressed against the transfer driving roller 51 on an opposite side of the intermediate transfer belt 11.

A bias is applied between the transfer driving roller 51 and the transfer driven roller 52. In this way, the charged toner moves towards the transfer driven roller 52 from the intermediate transfer belt 11. Thus, the toner image of each color overlapped on the surface of the intermediate transfer belt 11 is transferred to the sheet S from the intermediate transfer belt 11 at the transfer position 5A.

In addition, when the transfer of the toner image to the sheet S is not required, the transfer driven roller 52 is moved to a retracting position by a roller releasing mechanism (not shown). The retracting position is set to a position where the transfer driven roller 52 does not contact the intermediate transfer belt 11.

The register roller pair 7 is arranged at a given position on the conveyance path 5 between the sheet housing section 4 and the transfer position 5A. The register roller pair 7 includes a register driving roller 71 and a register driven roller 72. The register driving roller 71 is rotated in a given direction. The register driven roller 72 is pressed against the register driving roller 71 at a given pressure by a pressure mechanism (not shown). The sheet S conveyed from the sheet housing section 4 passes through the register roller pair 7 and then enters the transfer position 5A. The register roller pair 7 adjusts the conveyance direction of the sheet S before the sheet S enters the transfer position 5A.

The sheet S conveyed from the sheet housing section 4 towards the transfer position 5A along the conveyance path 5 is temporarily stopped when abutting against the register roller pair 7. There may be a case in which the sheet S is inclined when being picked up from the sheet housing section 4. Further, there may be a case in which the sheet S is inclined when being conveyed from the sheet housing section 4 along the conveyance path 5. In the inclined state, the sides of the inclined sheet S are not aligned with the conveyance direction perpendicular to the rotation axis of the register roller pair 7. In such a case, the straight line of the front end of the sheet S is not parallel to the rotation axis of the register roller pair 7. However, the front end of the sheet S abuts against the register roller pair 7, so that the straight line of the front end of the sheet S becomes parallel to the rotation axis of the register roller pair 7. In this state, the register roller pair 7 nips the sheet S to correct the inclination of the sheet S in the conveyance direction.

The toner image is conveyed towards the transfer position 5A through the intermediate transfer belt 11. The register roller pair 7 is rotated again at the timing when the toner image reaches the transfer position 5A. The toner image is conveyed through the intermediate transfer belt 11 and reaches the transfer position 5A. The sheet S reaches the transfer position 5A at the timing when the toner image reaches the transfer position 5A. The sheet S is passed through the transfer position 5A to transfer the toner image to the sheet S.

The fixing device 6 applies heat and pressure to the toner image transferred to the sheet S. The toner image is fixed on the sheet S through the heat and pressure. The fixing device 6 includes a fixing driving roller 61 and a fixing driven roller 62. The fixing driving roller 61 rotates in a given direction. The fixing driven roller 62 is pressed against the fixing driving roller 61 at a given pressure by a pressure mechanism (not shown).

The sheet S on which the toner image is fixed by the fixing device 6 is guided to a sheet discharge section 1*a* along the conveyance path 5. The sheet discharge section 1*a* serves as one part of an exterior cover for covering the printer section 3. The sheet discharge section 1*a* is positioned between the scanner section 2 and the cover.

A branch point 8A is positioned at the downstream side of the fixing device 6 on the conveyance path 5. The branch point 8A guides the sheet S in a direction different from the sheet discharge section 1*a*. When printing is to be performed on both sides of the sheet S, the sheet S is temporarily discharged towards the sheet discharge section 1*a*. Then the sheet S is drawn into the printer section 3 again. The sheet S is then guided to the reversal unit 8 through the branch point 8A.

The reversal unit 8 conveys the sheet S along a conveyance path 81 in the reversal unit 8.

In the present embodiment, the upstream side of the flow of the sheet S conveyed on the conveyance path 81 is referred to as the upstream side of the conveyance path 81. The downstream side of the flow of the sheet S conveyed on the conveyance path 81 is referred to as the downstream side of the conveyance path 81.

The reversal unit 8 includes a reversal unit register roller pair 82. Similar to the register roller pair 7, the reversal unit register roller pair 82 temporarily stops the sheet S conveyed on the conveyance path 81. In this way, the inclination of the sheet S is corrected. Further, the reversal unit register roller pair 82 restarts the conveyance of the sheet S at the timing when the toner image (corresponding to a second side of the sheet S) reaches the transfer position 5A. The sheet S conveyed from the reversal unit register roller pair 82 is merged with the conveyance path 5.

On the conveyance path 5, there is a position where the sheet S discharged from the reversal unit register roller pair 82 is merged with the conveyance path 5. The sheet S can also be inserted to the conveyance path 5 from a manual feeding tray 83 at the upstream side of the position where the sheet S is merged with the conveyance path 5. For example, a large-sized sheet S that cannot be stored in the sheet housing section 4 is inserted from the manual feeding tray 83.

Figure 2:
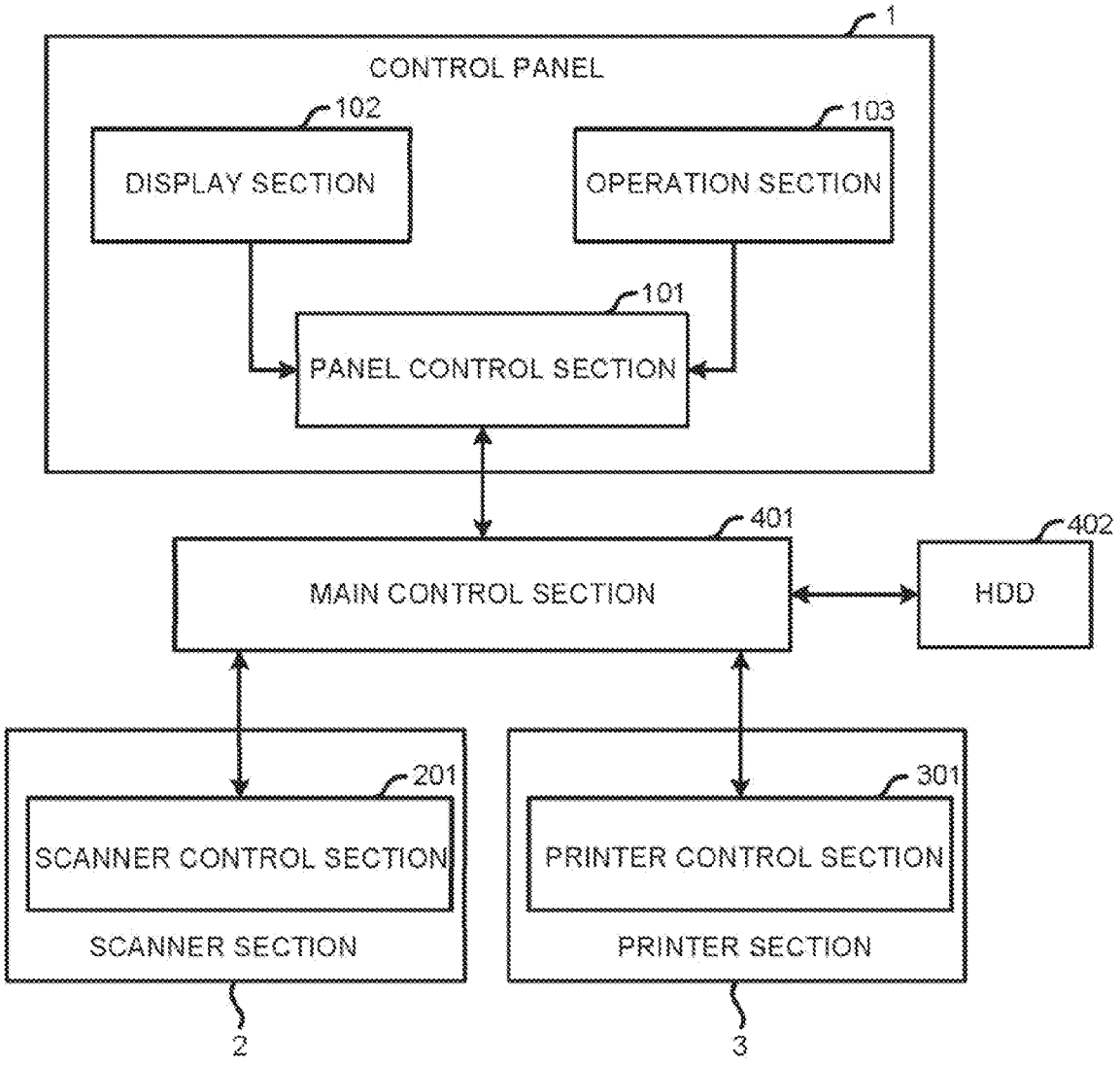
FIG. 2 is a block diagram illustrating an example configuration of the image forming apparatus.

Next, the image forming apparatus 100 is described with reference to FIG. 2. FIG. 2 is a block diagram illustrating an example configuration of the image forming apparatus 100.

A control panel 1 and the scanner section 2 and the printer section 3 described above are connected with a main control section 401. The main control section 401 controls the operations of the image forming apparatus 100. The main control section 401 is connected with an HDD (Hard Disk Drive) 402. The main control section 401 includes a CPU (Central Processing Unit), an ROM (read only memory) and an RAM (Random Access Memory).

The HDD 402, which is a memory such as a semiconductor storage device, a magnetic storage device and the like, stores programs and the like for the main control section 401.

The control panel 1 includes a panel control section 101, a display section 102 and an operation section 103. The panel control section 101, which includes a CPU, an ROM and an RAM, controls the control panel 1.

The display section 102 outputs a screen corresponding to the operation content or an image corresponding to an instruction from the main control section 401.

The operation section 103, which includes various keys, receives an operation from a user, and outputs a signal indicating the operation content to the panel control section 101.

The display section 102 and the operation section 103 may be integrally arranged as a touch panel type display.

In the present embodiment, the main control section 401 displays various settings such as the number of printings, the size and the category of the sheet S, and the like on the display section 102. The operation section 103 can receive a designation and a change of the setting. For example, information relating to the setting is displayed on the display section 102. For example, the information indicating the category of the sheet S can be designated through the operation section 103. The operation section 103 outputs the information indicating the designated category of the sheet S to a printer control section 301. The printer control section 301 writes the designated category of the sheet S in the RAM arranged inside.

The scanner section 2 is provided with a scanner control section 201. The scanner control section 201, which includes a CPU, an ROM and an RAM, controls the scanner section 2 to read image information.

The printer section 3 is provided with a printer control section 301. The printer control section 301, which includes a CPU, an ROM and an RAM, controls the printer section 3 to print an image on the sheet S.

Figure 3:
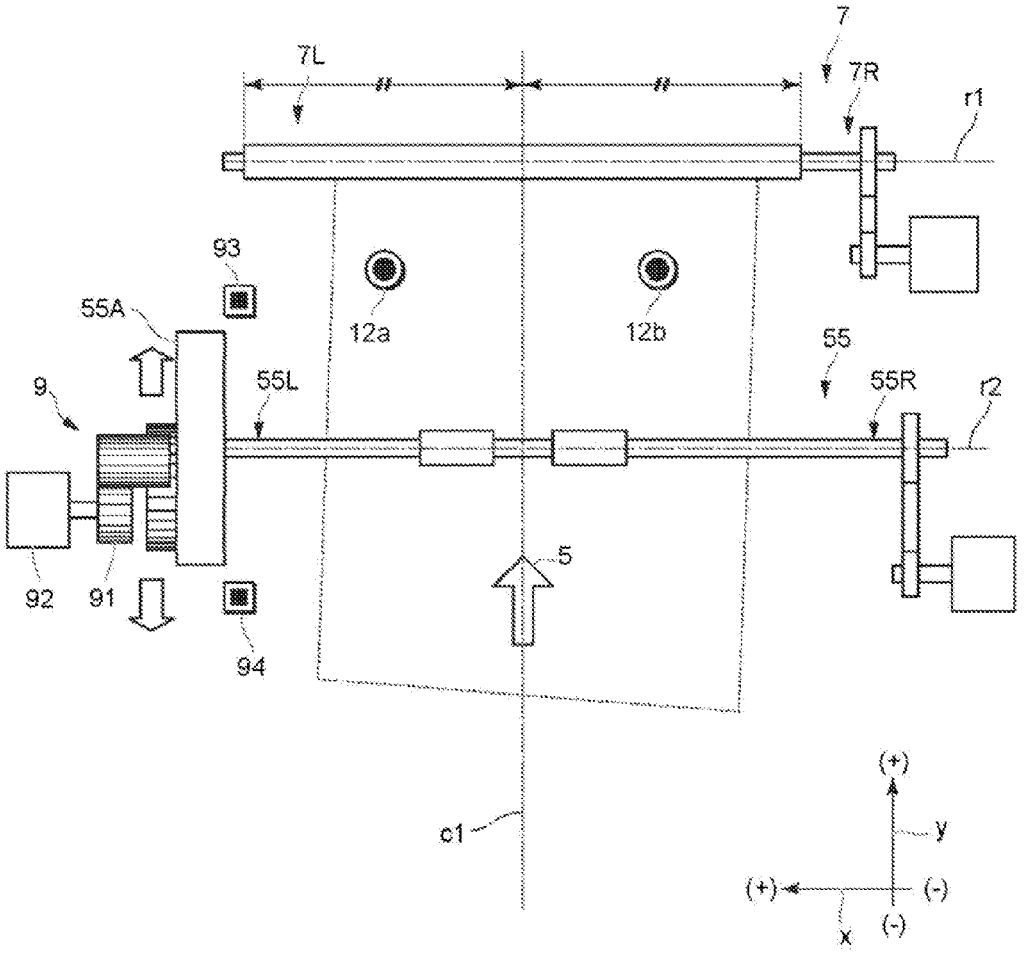
FIG. 3 is a diagram illustrating only a conveyance roller pair and a register roller pair of the image forming apparatus.

Next, the conveyance roller pair 55 and the register roller pair 7 are described in detail with reference to FIG. 3. FIG. 3 is a diagram illustrating only the conveyance roller pair 55 and the register roller pair 7 of the image forming apparatus 100. FIG. 3 is a diagram viewed from a direction orthogonal to a rotation axis r1 of the register roller pair 7. Herein, the rotation axis of the register driving roller 71 and the rotation axis of the register driven roller 72 are collectively referred to as the rotation axis r1.

On the paper surface, a straight line parallel to the rotation axis r1 of the register roller pair 7 is defined as the x-axis. A straight line orthogonal to the rotation axis r1 of the register roller pair 7 is defined as the y-axis. The right side of the paper surface is the minus direction of the x-axis. The left side of the paper surface is the plus direction of the x-axis. The upper side of the paper surface is the plus direction of the y-axis. The lower side of the paper surface is the minus direction of the y-axis. A direction from the minus direction of the y-axis towards the plus direction of the y-axis is the conveyance direction of the conveyance path 5.

The register roller pair 7 has an end part 7R at one end and an end part 7L at the other end.

When the conveyance roller pair 55 is positioned at a reference position, a rotation axis r2 of the conveyance roller pair 55 is parallel to the rotation axis r1 of the register roller pair 7. The rotation axis of the conveyance driving roller 56 and the rotation axis of the conveyance driven roller 57 are collectively referred to as the rotation axis r2.

The conveyance roller pair 55 is arranged at the upstream side of the register roller pair 7 on the conveyance path 5. The front end of the sheet S abuts against the register roller pair 7. The conveyance roller pair 55 is stopped while it is nipping the sheet S. The sheet S shown in FIG. 3 is inclined from the conveyance direction orthogonal to the rotation axis r1 of the register roller pair 7. The conveyance roller pair 55 holds the inclined sheet S as is.

The conveyance roller pair 55 has an end part 55R at one end and an end part 55L at the other end. A connection section 55A is connected with the end part 55L of the conveyance roller pair 55. The connection section 55A includes a connection section connected with the end part 55L of the conveyance driving roller 56 and a connection section connected with the end part 55L of the conveyance driven roller 57. The connection section 55A is connected with a movable section 9. The end part 55R of the conveyance roller pair 55 is supported so that the conveyance roller pair 55 is rotatable around an axis orthogonal to the x-y plane as the movable section 9 is moved.

The movable section 9 moves in the plus direction or the minus direction of the y-axis. The conveyance roller pair 55 rotates around an axis orthogonal to the x-y plane along with the movement of the movable section 9.

As stated above, the movable section 9 is connected with the conveyance driving roller 56 and the conveyance driven roller 57 through the connection section 55A. With such a configuration, the movable section 9 moves the rotation axis of the conveyance driving roller 56 and the rotation axis of the conveyance driven roller 57 at the same time.

The movable section 9 includes a transmission section 91 and a motor 92. The transmission section 91 transmits the driving force of the motor 92 to the conveyance roller pair 55 through the connection section 55A.

Position sensors 93 and 94 are arranged nearby the connection section 55A. The position sensor 93 is arranged near one end of the connection section 55A at the side of the plus direction of the y-axis. The position sensor 94 is arranged near the other end of the connection section 55A at the side of the minus direction of the y-axis.

When the connection section 55A is not moved by the movable section 9, the conveyance roller pair 55 is positioned at the reference position. The reference position refers to a position where the rotation axis r2 of the conveyance roller pair 55 is parallel to the rotation axis r1 of the register roller pair 7.

When the connection section 55A is moved in the plus direction of the y-axis by the movable section 9, the position sensor 93 detects the connection section 55A of the conveyance roller pair 55. That is, the position sensor 93 detects a state in which the end part 55L of the rotation axis r2 of the conveyance roller pair 55 is inclined to a position that is at the downstream side of the reference position on the conveyance path 5. In the present embodiment, the position sensor 93 detects an inclination angle α of the conveyance roller pair 55 against the reference position.

When the connection section 55A is moved in the minus direction of the y-axis by the movable section 9, the position sensor 94 detects the connection section 55A of the conveyance roller pair 55. That is, the position sensor 94 detects a state in which the end part 55L of the rotation axis r2 of the conveyance roller pair 55 is inclined to a position at the upstream side of the reference position on the conveyance path 5. In the present embodiment, the position sensor 94 detects an inclination angle β of the conveyance roller pair 55 against the reference position.

Distance measurement sensors 12*a* and 12*b* are arranged between the conveyance roller pair 55 and the register roller pair 7. The distance measurement sensors 12*a* and 12*b* detect the deflection amount of the sheet S. The deflection amount detected by the distance measurement sensors 12*a* and 12*b* refers to the deflection amount of the sheet S in a state in which the front end thereof is pressed against the register roller pair 7.

The distance measurement sensor 12*a* is arranged at a position close to the end part 7L at one end of the register roller pair 7 with respect to a center line c1 of the rotation axis r1 of the register roller pair 7.

The distance measurement sensor 12*b* is arranged at a position close to the end part 7R at the other end of the register roller pair 7 with respect to the center line c1 of the rotation axis r1 of the register roller pair 7.

The center line c1 is a straight line passing through the center position which bisects the register roller pair 7 in the direction of the rotation axis r1. The center line c1 is orthogonal to the rotation axis r1 of the register roller pair 7.

Figure 4:
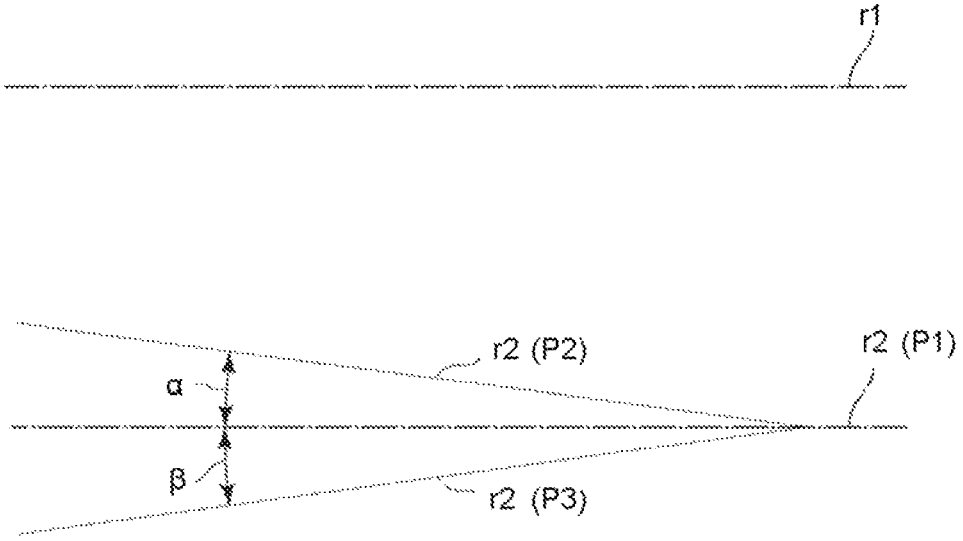
FIG. 4 is a diagram illustrating one example of inclination angles of the conveyance roller pair.

FIG. 4 is a diagram illustrating one example of the inclination angles α and β of the conveyance roller pair 55.

When the conveyance roller pair 55 is positioned at a reference position P1, the rotation axis r2 of the conveyance roller pair 55 and the rotation axis r1 of the register roller pair 7 are parallel to each other.

When the end part 55L of the conveyance roller pair 55 is moved closer to the register roller pair 7 (compared with the reference position P1), the rotation axis r2 of the conveyance roller pair 55 is at a position P2 with the inclination angle α against the reference position P1.

When the end part 55L of the conveyance roller pair 55 is moved further away from the register roller pair 7 (compared with the reference position P1), the rotation axis r2 of the conveyance roller pair 55 is at a position P3 with the inclination angle β against the reference position P1.

In the present embodiment, the position sensors 93 and 94 detect the inclination angle α or β of the rotation axis r2 based on the light quantity at the sensor surface, which changes according to the area of the sensor surface shielded by the connection section 55A. The position sensors 93 and 94 detect the inclination angles α and β of the rotation axis r2 based on the change in the light quantity at the sensor surface.

The printer control section 301 moves the movable section 9 to move the conveyance roller pair 55 to a control position determined according to the inclination angles α and β. The printer control section 301 confirms whether or not the position of the conveyance roller pair 55 is the control position based on the inclination angles α and β detected by the position sensors 93 and 94. The printer control section 301 adjusts movement amount of the movable section 9 to position the conveyance roller pair 55 at the control position.

Figure 5:
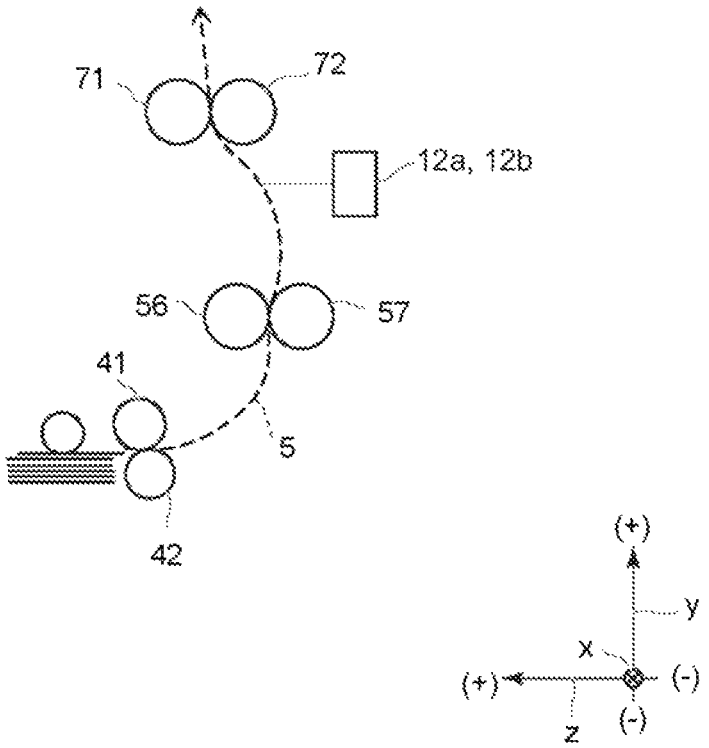
FIG. 5 is a schematic diagram illustrating the sheet conveyance path including the sheet feed roller pair, the conveyance roller pair, and the register roller pair.

FIG. 5 is a schematic diagram illustrating the sheet conveyance path including the sheet feed roller pair, conveyance roller pair, and the register roller pair. As described herein, a direction orthogonal to the y-axis is defined as the z-axis.

The distance measurement sensors 12*a* and 12*b* measure a distance to the sheet S in the z-axis direction. When the deflection amount of the sheet S is increased, the distance between the distance measurement sensors 12*a* and 12*b* and the sheet S is reduced. When the deflection amount of the sheet S is reduced, the distance between the distance measurement sensors 12*a* and 12*b* and the sheet S is increased.

The distance measurement sensors 12*a* and 12*b* calculate a predetermined deflection amount according to the measured distance. For example, the deflection amount corresponding to the measured distance is specified in a table data.

Figure 6:
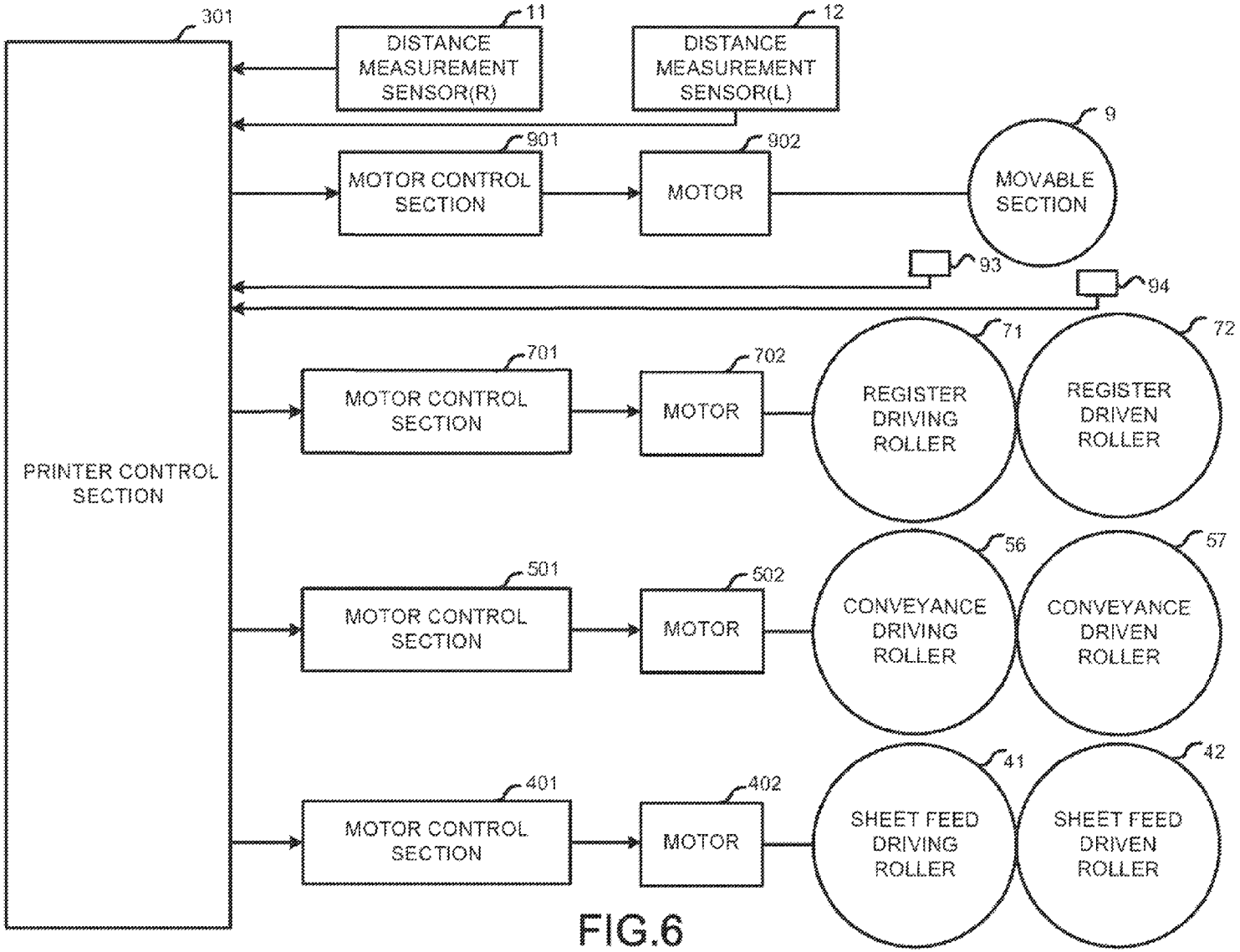
FIG. 6 is a block diagram illustrating an example configuration of one part of the image forming apparatus.

Next, the constitution of one part of the image forming apparatus 100 is described in detail with reference to FIG. 6. FIG. 6 is a block diagram illustrating an example configuration of one part of the image forming apparatus 100.

As shown in FIG. 6, the sheet feed driving roller 41 is connected with a motor 402. The motor 402 is connected with a motor control section 401. The motor control section 401 is connected with the printer control section 301. The motor control section 401 rotates the motor 402 at a designated rotation speed. The rotation speed is designated and controlled through the printer control section 301. The sheet feed driving roller 41 is rotated along with the rotation of the motor 402. The movement of the sheet feed driving roller 41 is transmitted to the sheet feed driven roller 42. Thus, the sheet feed driven roller 42 rotates in a direction opposite to that of the sheet feed driving roller 41.

The conveyance driving roller 56 is connected with a motor 502. The motor 502 is connected with a motor control section 501. The motor control section 501 is connected with the printer control section 301. The motor control section 501 rotates the motor 502 at a designated rotation speed. The rotation speed is designated and controlled through the printer control section 301. The conveyance driving roller 56 is rotated along with the rotation of the motor 502. The movement of the conveyance driving roller 56 is transmitted to the conveyance driven roller 57. Thus, the conveyance driven roller 57 rotates in a direction opposite to that of the conveyance driving roller 56.

The register driving roller 71 is connected with a motor 702. The motor 702 is connected with a motor control section 701. The motor control section 701 is connected with the printer control section 301. The motor control section 701 rotates the motor 702 at a designated rotation speed. The rotation speed is designated and controlled through the printer control section 301. The register driving roller 71 is rotated along with the rotation of the motor 702. The movement of the register driving roller 71 is transmitted to the register driven roller 72. Thus, the register driven roller 72 rotates in a direction opposite to that of the register driving roller 71.

Figure 7:
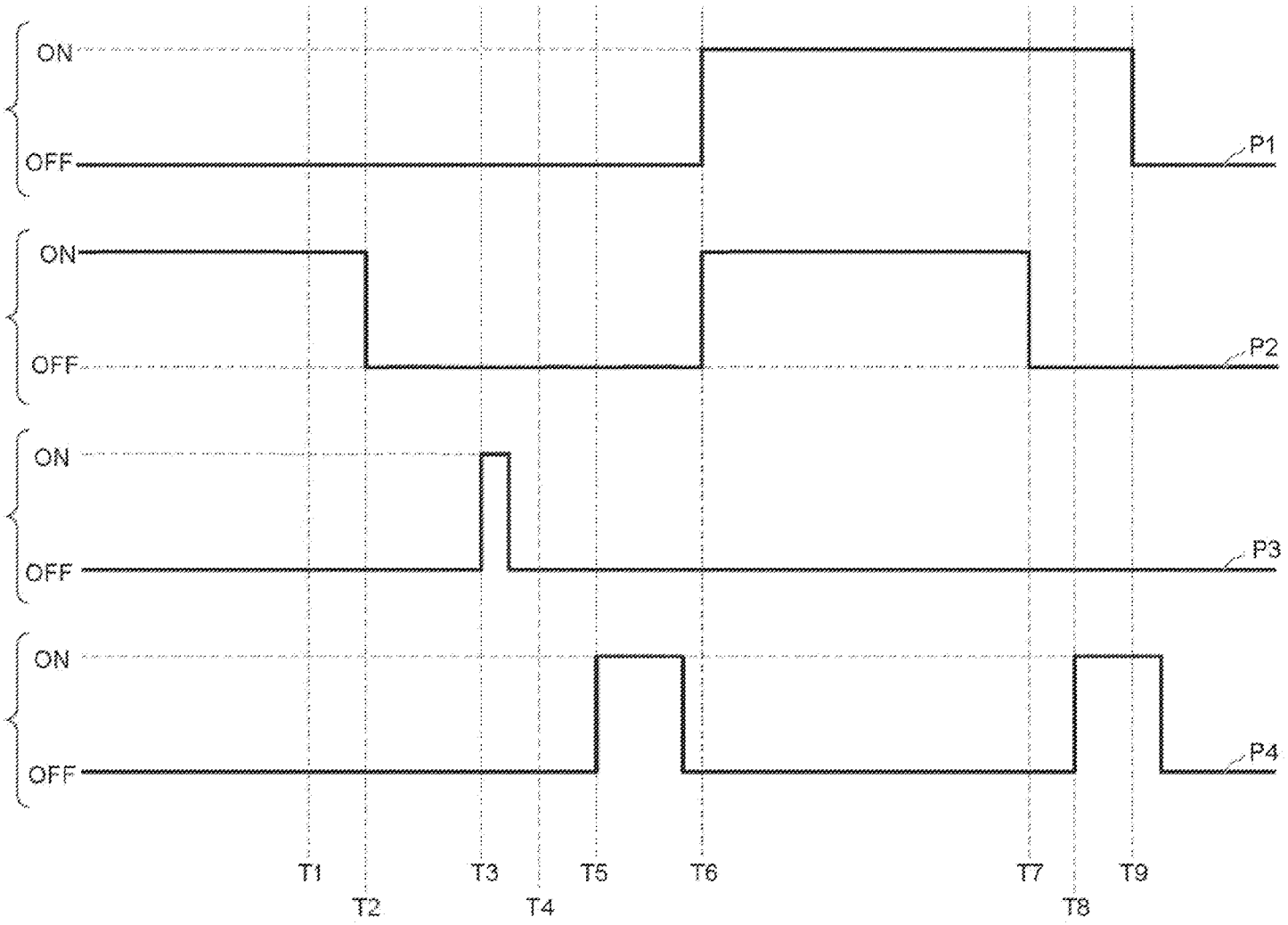
FIG. 7 is a timing chart illustrating the timing of the processing carried out in the image forming apparatus.

Next, the timing of the processing carried out by the image forming apparatus 100 is described with reference to FIG. 7. FIG. 7 is a timing chart illustrating the timing of the processing carried out in the image forming apparatus 100.

A timing chart P1 represents the rotation state of the register roller pair 7. "ON" of the timing chart P1 indicates that the register roller pair 7 is being rotated. "OFF" of the timing chart P1 indicates that the register roller pair 7 is stopped.

A timing chart P2 represents the rotation state of the conveyance roller pair 55. "ON" of the timing chart P2 indicates that the conveyance roller pair 55 is being rotated. "OFF" of the timing chart P2 indicates that the conveyance roller pair 55 is stopped.

A timing chart P3 represents the detection state of the distance measurement sensors 12*a* and 12*b*. "ON" of the timing chart P3 indicates that the distance measurement sensors 12*a* and 12*b* are detecting the deflection amount. "OFF" of the timing chart P3 indicates that the distance measurement sensors 12*a* and 12*b* are not detecting the deflection amount.

A timing chart P4 represents the operation state of the movable section 9. "ON" of the timing chart P4 indicates that the movable section 9 is operating. "OFF" of the timing chart P4 indicates that the movable section 9 is not operating.

A time T1 represents a time when the front end of the sheet S contacts with the register roller pair 7. The conveyance roller pair 55 rotates for a given time from the time T1 when the front end of the sheet S contacts with the register roller pair 7. In this way, the front end of the sheet S is pressed against the register roller pair 7. The sheet S is deflected when being pressed against the register roller pair 7. The printer control section 301 stops the conveyance roller pair 55 after the given time elapses from the time T1.

A time T2 represents a time when the conveyance roller pair 55 is stopped. The printer control section 301 instructs the distance measurement sensors 12*a* and 12*b* to detect the deflection amount after stopping the conveyance roller pair 55.

A time T3 represents a time when the distance measurement sensors 12*a* and 12*b* starts to detect the deflection amount. The distance measurement sensor 12*a* detects a deflection amount Q1. The distance measurement sensor 12*a* outputs information indicating the deflection amount Q1 to the printer control section 301. The distance measurement sensor 12*b* detects a deflection amount Q2. The distance measurement sensor 12*b* outputs information indicating the deflection amount Q2 to the printer control section 301.

The printer control section 301 determines whether or not the deflection amount of the sheet S is uniform based on the deflection amounts Q1 and Q2. A time T4 represents a time when the printer control section 301 determines whether or not the deflection amount of the sheet S is uniform.

When it is determined that the deflection amount is not uniform, the printer control section 301 determines the movement direction and the movement amount of the movable section 9 based on the deflection amounts Q1 and Q2. The printer control section 301 moves the movable section 9 in the "determined direction". A time T5 represents a time when the printer control section 301 starts to move the movable section 9.

The printer control section 301 determines, based on the detection results of the position sensors 93 and 94, whether or not the movable section 9 is moved in the "determined direction" for the "determined movement amount". If it is determined that the movable section 9 has moved in the "determined direction" for the "determined movement amount", the printer control section 301 rotates the conveyance roller pair 55 and the register roller pair 7. A time T6 represents a time when the rotation of the conveyance roller pair 55 and the register roller pair 7 is started.

The sheet S is conveyed along the conveyance path 5 through the rotation of the conveyance roller pair 55 and the register roller pair 7.

The printer control section 301 determines whether or not the sheet S has passed through the conveyance roller pair 55. If it is determined that the sheet S has passed through the conveyance roller pair 55, the printer control section 301 stops the conveyance roller pair 55. A time T7 represents a time when the conveyance roller pair 55 is stopped.

After the conveyance roller pair 55 is stopped, the printer control section 301 moves the movable section 9 back to the reference position. In this way, the rotation axis r2 of the conveyance roller pair 55 and the rotation axis r1 of the register roller pair 7 are parallel to each other. A time T8 represents a time when the printer control section 301 starts to move the movable section 9.

The printer control section 301 determines whether or not the sheet S has passed through the register roller pair 7. If it is determined that the sheet S has passed through the register roller pair 7, the printer control section 301 stops the register roller pair 7. A time T9 represents a time when the register roller pair 7 is stopped.

Figure 8:
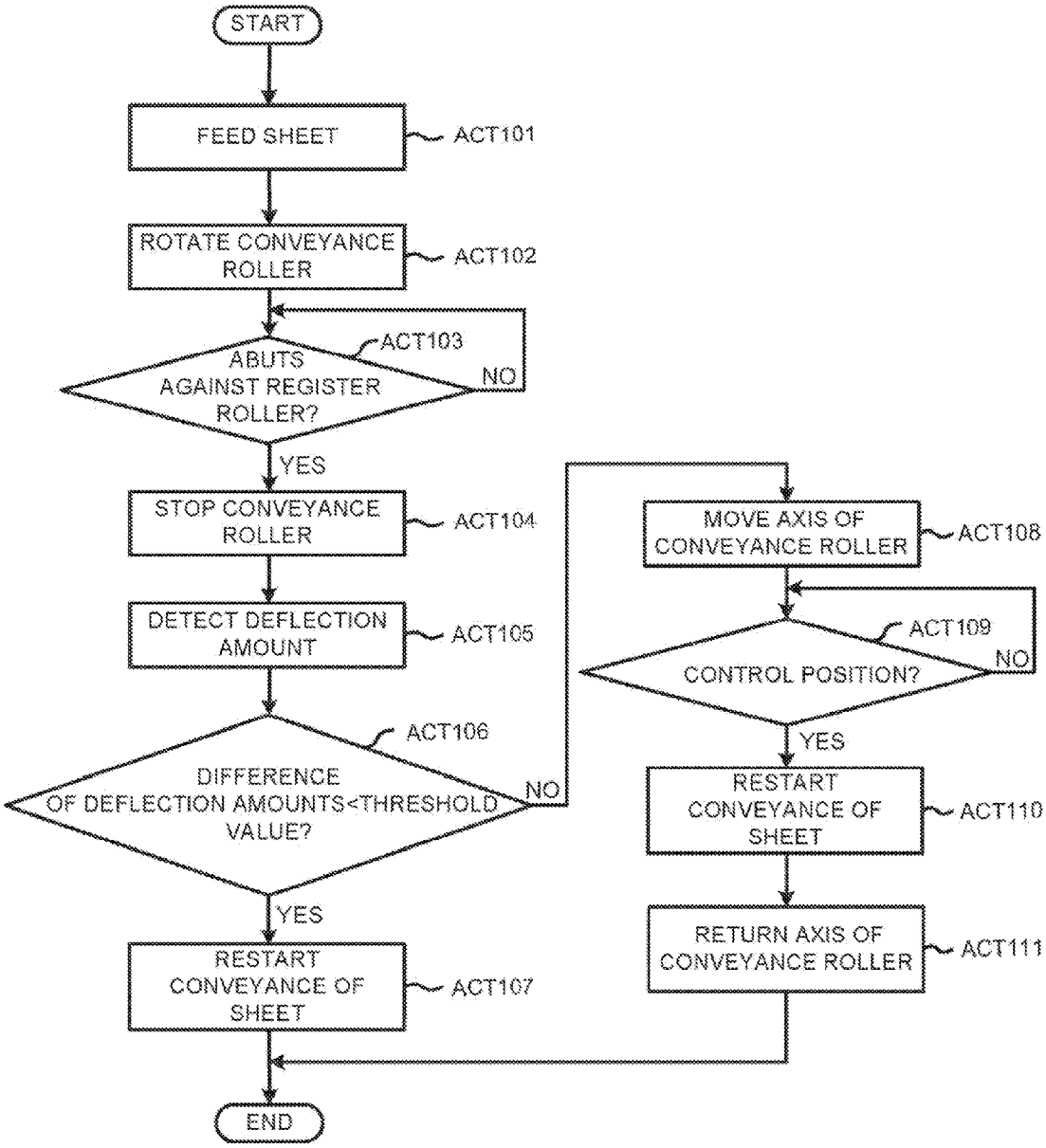
FIG. 8 is a flowchart illustrating part of the processing carried out in the image forming apparatus.

Next, part of the processing carried out in the image forming apparatus 100 is described with reference to FIG. 8. FIG. 8 is a flowchart illustrating part of the processing carried out in the image forming apparatus 100. The image forming apparatus 100 repeatedly executes the processing shown in FIG. 8 for each sheet S.

The printer control section 301 rotates the sheet feed driving roller 41. The movement of the sheet feed driving roller 41 is transmitted to the sheet feed driven roller 42. Thus, the sheet feed driven roller 42 rotates in a direction opposite to that of the sheet feed driving roller 41. The sheet S picked up from the sheet housing section 4 is conveyed towards the conveyance roller pair 55 by the sheet feed roller pair 40 (ACT 101).

The printer control section 301 rotates the conveyance driving roller 56 (ACT 102). The movement of the conveyance driving roller 56 is transmitted to the conveyance driven roller 57. Thus, the conveyance driven roller 57 rotates in a direction opposite to that of the conveyance driving roller 56. The sheet S conveyed from the sheet feed roller pair 40 is conveyed towards the register roller pair 7 by the conveyance roller pair 55.

The printer control section 301 determines whether or not the front end of the sheet S abuts against the register roller pair 7 (ACT 103).

If it is determined that the front end of the sheet S abuts against the register roller pair 7 (YES in ACT 103), the printer control section 301 stops the conveyance roller pair 55 (ACT 104).

If it is determined that the front end of the sheet S does not abut against the register roller pair 7 (NO in ACT 103), the printer control section 301 continues rotating the conveyance roller pair 55 until the front end of the sheet S abuts against the register roller pair 7.

The printer control section 301 instructs the distance measurement sensors 12*a* and 12*b* to detect the deflection amount (ACT 105). The distance measurement sensor 12*a* detects the deflection amount Q1 of the sheet S based on the distance to the sheet S it faces. Herein, the detected deflection amount Q1 of the sheet S is the deflection amount of the sheet S corresponding to the left side of the conveyance direction. The distance measurement sensor 12*a* outputs the information indicating the deflection amount Q1 to the printer control section 301. The distance measurement sensor 12*b* detects the deflection amount Q2 of the sheet S based on the distance to the sheet S it faces. Herein, the detected deflection amount Q2 of the sheet S is the deflection amount of the sheet S corresponding to the right side of the conveyance direction. The distance measurement sensor 12*b* outputs the information indicating the deflection amount Q2 to the printer control section 301.

The printer control section 301 calculates an absolute value (|Q1−Q2|) of the difference between the deflection amount Q1 and the deflection amount Q2.

The printer control section 301 compares the calculated absolute value (|Q1−Q2|) with a threshold value th1 (ACT 106).

If the absolute value (|Q1−Q2|) is smaller than the threshold value th1 (YES in ACT 106), the printer control section 301 determines that the deflection amount of the sheet S is uniform.

Then, the printer control section 301 restarts the conveyance of the sheet S (ACT 107). That is, the printer control section 301 rotates the conveyance roller pair 55 and the register driving roller 71.

If the absolute value (|Q1−Q2|) is greater than the threshold value th1 (NO in ACT 106), the printer control section 301 determines that the deflection amount of the sheet S is not uniform.

Sequentially, the printer control section 301 determines the movement direction of the movable section 9 based on the difference between the deflection amount Q1 and the deflection amount Q2. In the present embodiment, in a case in which the deflection amount Q1 is greater than the deflection amount Q2 (Q1>Q2), the printer control section 301 determines the movement direction of the movable section 9 to be the minus direction (that is, the upstream side of the reference position on the conveyance path 5) of the y-axis. In a case in which the deflection amount Q1 is smaller than the deflection amount Q2 (Q1<Q2), the printer control section 301 determines the movement direction of the movable section 9 to be the plus direction (that is, the downstream side of the reference position on the conveyance path 5) of the y-axis.

The printer control section 301 determines the inclination angles α and β of the conveyance roller pair 55 based on the absolute value (|Q1−Q2|). The inclination angles α and β of the conveyance roller pair 55 are predetermined according to the absolute value (|Q1−Q2|). The absolute value (|Q1−Q2|) corresponding to the inclination angles α and β of the conveyance roller pair 55 is specified in a table. The printer control section 301 determines the inclination angles α and β of the conveyance roller pair 55 corresponding to the absolute value (|Q1−Q2|) by reference to the table.

The printer control section 301 moves the movable section 9 in the determined direction (ACT 108). In this way, the conveyance roller pair 55 rotates around an axis orthogonal to the x-y plane.

The printer control section 301 determines whether or not the conveyance roller pair 55 is positioned at the control position shown by the inclination angle α or β based on the detection result of the position sensors 93 and 94 (ACT 109). When the conveyance roller pair 55 is not positioned at the control position (NO in ACT 109), the printer control section 301 continues to move the movable section 9 until the conveyance roller pair 55 is positioned at the control position.

When the conveyance roller pair 55 is positioned at the control position (YES in ACT 109), the printer control section 301 restarts the conveyance of the sheet S (ACT 110). That is, the printer control section 301 rotates the conveyance roller pair 55 and the register driving roller 71.

After the sheet S passes through the register roller pair 7, the printer control section 301 stops the rotation of the conveyance driving roller 56 and the register driving roller 71. Sequentially, the printer control section 301 moves the movable section 9 back to the reference position (ACT 111). In this way, the rotation axis r2 of the conveyance roller pair 55 and the rotation axis r1 of the register roller pair 7 are parallel to each other.

As stated above, the image forming apparatus 100 according to the embodiment inclines the rotation axis of the conveyance roller pair 55 from the reference position parallel to the rotation axis r1 of the register roller pair 7 based on the deflection amount. With such a constitution, the image forming apparatus 100 can reduce the variation of the deflection amount in the direction parallel to the rotation axis r1 of the register roller pair 7. Thus, the wrinkle caused when the sheet S is drawn by the register roller pair 7 can be prevented.

In a case in which the deflection amount in the direction parallel to the rotation axis r1 of the register roller pair 7 is not uniform, the image forming apparatus 100 according to the embodiment inclines the rotation axis of the conveyance roller pair 55 from the reference position. With such a constitution, the image forming apparatus 100 can move the rotation axis of the conveyance roller pair 55 in a case in which the deflection amount in the direction parallel to the rotation axis r1 of the register roller pair 7 is not uniform. The variation of the deflection amount in the direction parallel to the rotation axis r1 of the register roller pair 7 can be reduced.

The image forming apparatus 100 according to the embodiment determines the inclination of the rotation axis of the conveyance roller pair 55 based on the difference of the deflection amounts in the direction parallel to the rotation axis r1 of the register roller pair 7. With such a constitution, the image forming apparatus 100 can make the deflection amount in the direction parallel to the rotation axis r1 of the register roller pair 7 uniform. In other words, the image forming apparatus 100 can make the deflection of the sheet S uniform at the left and right side of the conveyance direction. Thus, the wrinkle caused when the sheet S is drawn by the register roller pair 7 can be prevented.

The image forming apparatus 100 according to the embodiment inclines the rotation axis r2 of the conveyance roller pair 55 from the reference position based on the detection results of the position sensors 93 and 94 for detecting the position of the movable section 9 and the determined inclination of the rotation axis r2 of the conveyance roller pair 55. With such a constitution, the position of the conveyance roller pair 55 can be estimated based on the actual position of the movable section 9. Thus, the image forming apparatus 100 can correctly control the inclination of the rotation axis of the conveyance roller pair 55.

The image forming apparatus 100 according to the embodiment moves the movable section 9 in a predetermined direction according to the magnitude relation of the deflection amounts Q1 and Q2.

When the deflection amount Q2 occurring at the side near the end part 7R of the register roller pair 7 is larger than the deflection amount Q1 occurring at the side near the end part 7L of the register roller pair 7, the printer control section 301 moves the end part 55L of the conveyance roller pair 55 to a position at the downstream side of the reference position on the conveyance path 5.

When the deflection amount Q2 occurring at the side near the end part 7R of the register roller pair 7 is smaller than the deflection amount Q1 occurring at the side near the end part 7L of the register roller pair 7, the printer control section 301 move the end part 55L of the conveyance roller pair 55 to a position at the upstream side of the reference position on the conveyance path 5. With such a configuration, the image forming apparatus 100 can make the deflection amount in the direction parallel to the rotation axis r1 of the register roller pair 7 uniform.

The image forming apparatus 100 according to the embodiment is provided with a distance measurement sensor 12*a* at a position near the end part 7L at one end of the register roller pair 7 and a distance measurement sensor 12*b* at a position near the end part 7R at the other end of the register roller pair 7. With such a configuration, the image forming apparatus 100 can determine whether or not the deflection amount in the direction parallel to the rotation axis r1 of the register roller pair 7 is uniform. In other words, the image forming apparatus 100 can determine whether or not the deflection of the sheet S is uniform at the left and right side of the conveyance direction.

The image forming apparatus 100 according to the embodiment returns the rotation axis of the conveyance roller pair 55 to the reference position after the sheet S passes through the register roller pair 7. With such a configuration, the next sheet S can be conveyed along the conveyance direction.

In the image forming apparatus 100 according to the embodiment, the end part 55R at the other end of the conveyance roller pair 55 pivots around an axis extending in a direction orthogonal to the rotation axis r2 of the conveyance roller pair 55. With such a configuration, the movable section 9 arranged at the end part 55L at one end of the conveyance roller pair 55 is moved. In this way, the rotation axis r2 of the conveyance roller pair 55 can be inclined from the reference position. Thus, there is no need to arrange the movable section 9 at the end part 55R at the other end of the conveyance roller pair 55, which can reduce the cost.

In the image forming apparatus 100 according to the embodiment, the movable section 9 moves the rotation axis of the conveyance driving roller 56 and the rotation axis of the conveyance driven roller 57 included in the conveyance roller pair 55 at the same time. With such a constitution, the conveyance roller pair 55 is moved by the movable section 9 while it is nipping the sheet S. Thus, the image forming apparatus 100 can change the conveyance direction of the sheet S easily by moving the conveyance roller pair 55.

In addition, though the image forming apparatus 100 which fixes the toner image on the sheet is exemplified, an inkjet type image forming apparatus can also be used.

A sheet sensor for detecting the sheet S may be arranged nearby the conveyance roller pair 55 and the register roller pair 7. The printer control section 301 detects whether or not the front end of the sheet S is in contact with the register roller pair 7 based on the detection result of the sheet sensor. The printer control section 301 detects whether or not the sheet S passes through the conveyance roller pair 55 based on the detection result of the sheet sensor. The printer control section 301 further detects whether or not the sheet S passes through the register roller pair 7 based on the detection result of the sheet sensor.

Moreover, the movable section 9 may also be arranged at the end part 55R at the other end of the conveyance roller pair 55.

The size and the position of each roller can be designed randomly.

While certain embodiments have been described, these embodiments have been presented by way of example only, and are not intended to limit the scope of the invention. Indeed, the novel embodiments described herein may be embodied in a variety of other forms; furthermore, various omissions, substitutions and changes in the form of the embodiments described herein may be made without departing from the spirit of the invention. The accompanying claims and their equivalents are intended to cover such forms or modifications as would fall within the scope and spirit of the invention.

What is claimed is:

1. A sheet conveyance apparatus, comprising:

a conveyance roller configured to convey a sheet;

a register roller which is arranged downstream of the conveyance roller along a sheet conveyance path;

a first sensor configured to detect a first deflection amount of the sheet when the sheet is pressed against the register roller;

a second sensor configured to detect a second deflection amount of the sheet when the sheet is pressed against the register roller;

a movable section connected to at least one end of the conveyance roller; and a control section configured to:

determine a tilt of a rotation axis of the conveyance roller relative to a rotation axis of the register roller based on a difference in the first and second deflection amounts detected by the first and second sensors, and control the movable section to move the at least one end of the conveyance roller so that the rotational axis of the conveyance roller is positioned relative to a rotational axis of the register roller in accordance with the determined tilt.

2. The sheet conveyance apparatus according to claim 1, wherein the control section moves the at least one end of the conveyance roller when the detected deflection amounts are not the same in a direction parallel to the rotational axis of the register roller.

3. The sheet conveyance apparatus according to claim 1, further comprising:

a position sensor configured to detect a position of the movable section, wherein the control section moves the at least one end of the conveyance roller based on a detection result of the position sensor and the determined tilt of the rotation axis of the conveyance roller.

4. The sheet conveyance apparatus according to claim 1, wherein the first deflection amount is detected at a side near a first end part of the register roller, the second deflection amount is detected at a side near a second end part of the register roller, and the control section moves the at least one end of the conveyance roller toward the register roller when the first deflection amount is smaller than the second deflection amount.

5. The sheet conveyance apparatus according to claim 4, wherein the control section moves the at least one end of the conveyance roller away from the register roller when the first deflection amount is larger than the second deflection amount.

6. The sheet conveyance apparatus according to claim 5, wherein the first and second sensors are arranged respectively at a first position near the first end part of the register roller and at a second position near the second end part of the register roller.

7. The sheet conveyance apparatus according to claim 1, wherein the control section moves the at least one end of the conveyance roller after the sheet passes through the register roller, so that the rotation axis of the conveyance roller is parallel to the rotation axis of the register roller.

8. The sheet conveyance apparatus according to claim 1, wherein the conveyance roller is supported at a second end opposite the at least one end so that the conveyance roller is rotatable around an adjustment axis extending in a direction orthogonal to the rotation axis of the conveyance roller.

9. The sheet conveyance apparatus according to claim 1, wherein the conveyance roller includes a conveyance driving roller and a conveyance driven roller and the movable section rotates respective rotation axes of the conveyance driving roller and the conveyance driven roller at the same time.

10. A method of conveying a sheet along a conveyance path using a conveyance roller and a register roller, which is arranged downstream of the conveyance roller along the conveyance path, the method comprising:

detecting a first deflection amount of the sheet at a first position near a first end part of the register roller when the sheet is pressed against the register roller;

detecting a second deflection amount of the sheet at a second position near a second end part of the register roller when the sheet is pressed against the register roller; and moving at least one end of the conveyance roller based on a difference in the detected first and second deflection amounts, to tilt a rotational axis of the conveyance roller relative to a rotational axis of the register roller.

11. The method according to claim 10, wherein the at least one end of the conveyance roller is moved when the detected first and second deflection amounts are not the same in a direction parallel to the rotational axis of the register roller.

12. The method according to claim 10, further comprising:

determining a desired tilt of the rotation axis of the conveyance roller relative to the rotation axis of the register roller based on the difference in the detected first and second deflection amounts.

13. The method according to claim 12, further comprising:

detecting an amount the at least one end of the conveyance roller is moved; and controlling the moving based on the detected amount and the desired tilt of the rotation axis of the conveyance roller.

14. The method according to claim 10, wherein the at least one end of the conveyance roller is moved toward the register roller when the detected first deflection amount is smaller than the detected second deflection amount.

15. The method according to claim 14, wherein the at least one end of the conveyance roller is moved away from the register roller when the detected first deflection amount is larger than the detected second deflection amount.

16. The method according to claim 10, wherein the at least one end of the conveyance roller is moved after the sheet passes through the register roller, so that the rotation axis of the conveyance roller is parallel to the rotation axis of the register roller.

17. The method according to claim 10, wherein the conveyance roller is supported at the other end so that the conveyance roller is rotatable around an axis extending in a direction orthogonal to the rotation axis of the conveyance roller.

18. The method according to claim 10, wherein the conveyance roller includes a conveyance driving roller and a conveyance driven roller configured such that the rotation axes of the conveyance driving roller and the conveyance driven roller are movable at the same time.

* * * * *